US010529179B2

(12) United States Patent
Weiss

(10) Patent No.: US 10,529,179 B2
(45) Date of Patent: Jan. 7, 2020

(54) ELECTRONIC GAMING MACHINE PROVIDING WINNING OUTCOMES AFTER LOSING EVENTS

(71) Applicant: Steven Weiss, Henderson, NV (US)

(72) Inventor: Steven Weiss, Henderson, NV (US)

( * ) Notice: Subject to any disclaimer, the term of this patent is extended or adjusted under 35 U.S.C. 154(b) by 247 days.

(21) Appl. No.: 15/490,899

(22) Filed: Apr. 19, 2017

(65) Prior Publication Data

US 2018/0308312 A1 Oct. 25, 2018

(51) Int. Cl.

*G07F 17/00* (2006.01)
*G07F 19/00* (2006.01)
*G07F 17/32* (2006.01)

(52) U.S. Cl.

CPC ..... *G07F 17/3227* (2013.01); *G07F 17/3211* (2013.01); *G07F 17/3244* (2013.01)

(58) Field of Classification Search

None

See application file for complete search history.

(56) References Cited

U.S. PATENT DOCUMENTS 4,448,419 A 5/1984 Telnaes
6,159,096 A 12/2000 Yoseloff
6,270,409 B1 * 8/2001 Shuster ..... G07F 17/3244 273/143 R
6,676,512 B2 1/2004 Fong
7,371,170 B2 5/2008 Cregan
7,585,222 B2 9/2009 Muir
7,789,749 B2 * 9/2010 Bansemer ..... A63F 9/0291 463/20
8,075,390 B2 * 12/2011 Walker ..... G07F 17/323 463/20
8,210,928 B2 * 7/2012 Walker ..... G07F 17/32 463/25
8,602,866 B2 * 12/2013 Acres ..... G07F 17/32 463/20
8,616,960 B2 * 12/2013 Prendergast ..... G07F 17/3244 463/25
8,992,307 B2 * 3/2015 Young ..... G07F 17/3258 463/25
9,305,435 B2 4/2016 Elkhoury
9,613,490 B2 * 4/2017 Gagner ..... G07F 17/32
9,613,501 B2 4/2017 Hoffman
(Continued)

*Primary Examiner* — Milap Shah
(74) *Attorney, Agent, or Firm* — Mark A. Litman & Assoc. P.A.

(57) ABSTRACT

An electronic gaining system moderates payout rates by the processor randomly providing a first random outcome which determines whether the wager is initially resolved by the processor as a winning outcome, tie outcome or losing outcome. The processor recognizes specific ones of, but less than all of the tie outcomes and/or the losing outcomes as belonging to a provisional subset of the outcomes and/or losing outcomes. The processor recognizes a random outcome as within the provisional subset, the processor randomly selecting from among multiple additional outcomes stored in memory for at least individual ones of random outcomes within the provisional subset, and randomly selecting a final random outcome for the at least individual one of the random outcomes within the provisional subset from a second set of random outcomes that includes at least one winning outcome, and resolving the wager on the basis of the final random outcome.

12 Claims, 4 Drawing Sheets

(56) References Cited

U.S. PATENT DOCUMENTS

| | | | | |
|---|---|---|---|---|
| 2003/0060276 | A1* | 3/2003 | Walker | G07F 17/3244 463/25 |
| 2003/0203751 | A1* | 10/2003 | Fox | G07F 17/3244 463/16 |
| 2006/0040729 | A1* | 2/2006 | Manz | G07F 17/3227 463/20 |
| 2007/0060254 | A1* | 3/2007 | Muir | G07F 17/32 463/16 |
| 2007/0225066 | A1* | 9/2007 | Duhamel | G07F 17/32 463/25 |
| 2008/0102921 | A1* | 5/2008 | Urquhart | G07F 17/34 463/20 |
| 2008/0113802 | A1* | 5/2008 | Johnson | G07F 17/3239 463/40 |
| 2015/0187175 | A1* | 7/2015 | Friedman | G07F 17/3244 463/20 |

* cited by examiner

ELECTRONIC GAMING MACHINE PROVIDING WINNING OUTCOMES AFTER LOSING EVENTS

BACKGROUND OF THE INVENTION

1. Field of the Invention

The present invention relates to the field of electronic gaining systems, and especially electronic gaining machines with paytables for symbol combinations or symbol organizations.

2. Background of the Art

Electronic gaining machines ("EGMs") offer a variety of games such as slot games, video poker games, roulette games, keno games and other types of wagering games that are commonly deployed at a casino for use by players. Play on the EGMs typically requires the player to place a wager on the outcome of a primary game. On many such EGMs, secondary games or bonus rounds are also available after the player qualifies by attaining a certain winning combination or event on or related to the primary game. The player would then enter the secondary game or bonus round where they have an opportunity to win extra game credits, game tokens or other awards. The player automatically enters the secondary game or bonus round upon achieving a winning game outcome, or alternatively, when a bonus symbol appears in a predetermined position on the reels of a slot game (or the game display of another type of game) upon completion of the game. The player may be awarded credits for winning the base game and then additional credits for winning the secondary game.

Historically, the format of game play with winning combinations entitling the player to enter a secondary or bonus round have worked well for players and gaining establishments. They generate player excitement and maintain the interest of the player. However, for a player who hits a streak of losses, it may result in the player leaving the game, and possibly the gaining establishment without further play. Numerous methods have been attempted to provide winning outcomes or potential winning outcomes based on a primary gaining event losing outcome.

U.S. Pat. No. 8,992,307 (Young) describes a gaining system and method for use in one or more casino establishments for offering a secondary game initiated after a loss. The gaining machine and method are offered on electronic gaining machines such as slot machines and video poker machines, but may also be deployed in other forms such as on a general purpose computing device in stand-alone form or connected to a network such as the internet. In an electronic gaining machine ("EGM") on which a player plays a base game with an opportunity to play a second chance game, there is a random number generator for generating random numbers that determine the outcome of a base game and that correspond to a predefined set of game outcomes including winning and losing outcomes. There are also a display for displaying game play screens including game outcomes to a player, a controller for controlling game play on the electronic gaining machine wherein in the event that the controller determines a winning outcome on the base game, and the display indicates the winning outcome to the player and the game ends. In the event the controller determines a losing outcome in the base game, the display indicates the losing outcome to the player and the controller causes a second chance game to be offered to the player. An EGM interface through which a player interacts with the EGM to accept or reject the second chance game offered to the player, and wherein if the player rejects the second chance game offered, the game ends; and if the player accepts the second chance game offer, a second chance game outcome is determined and a winning outcome results in the player receiving an award and the game ending, and a losing outcome results in the game ending without the player receiving an award.

In a non-electronic gaining system, U.S. Pat. No. 9,305,435 Elkhoury) provides a gaining system and method for redeeming a winning ticket and/or a plurality of non-winning tickets having corresponding symbols for an award. Generally, in various embodiments, the gaining system of the present disclosure enables a player to: (a) redeem a winning ticket for a first award, and (b) redeem a set of two or more non-winning tickets having corresponding symbols for a second award. Thus, while an individual ticket may be a non-winning ticket when standing alone, the gaining system of the present disclosure enables that non-winning ticket to provide value to the player (in the form of an award) when combined with at least one additional non-winning ticket.

U.S. Pat. No. 9,613,501 (Hoffman) describes an additional way to provide awards to players when a primary pay line is not a winning outcome. In addition to pay lines, there are other methods to award a player that include a "nudge" feature. A "nudge" occurs after the reels initially spin and stop. The "nudge" allows the game or the player to move the reels through a limited rotation from a first position "non-winning" position to a second position that is a "possibly winning position."

U.S. Pat. No. 7,585,222 (Muir) describes a gaining device having a game that includes several nearly missed outcomes associated with a designated outcome, where the player is provided an award for achieving a nearly missed outcome. If the player obtains the nearly missed outcome, the award is provided from a near miss insurance pool. Therefore, when a player nearly misses achieving a large jackpot, the gaining device provides the player with insurance payoff. In general, the near miss insurance pool is funded from a portion of each wager, and may be funded by several linked gaining devices.

U.S. Pat. No. 6,676,512 (Fong) "Gaming Machine with Mystery Nudge Symbol" describes a gaming machine having a display and a game controller arranged to control images displayed on the display. The game controller is arranged to play a game wherein at least one random event is caused to be displayed on the display. If a predefined winning event occurs, the machine awards a prize. The display displays a spinning reel game, each reel of which carries a plurality of symbols, at least one of which is a mystery symbol, the identity of which, at least initially, is hidden. When the mystery symbol appears on the display in a predetermined position, it is caused, by the controller and subject to predetermined conditions, to move to a different position whereafter the identity of the mystery symbol is revealed to be another symbol which is a symbol of a set of symbols of the game.

U.S. Pat. No. 7,371,170 (Cregan) further describes "nudge" events as including a gaining device with multiple symbols in different display positions which swap with one another upon a triggering event in a game. Gaining device manufacturers provide gaining machines having a plurality of reels, each reel including a plurality of symbols. In a reel game, the player causes the reels to spin by placing a wager on the game. The reels spin and then stop to display a generated combination of symbols on the reels. If a generated symbol or combination of symbols appears along an active pay line associated with the reels or in a scatter pay, and the symbol or the combination of symbols corresponds to, or is associated with, an award, the player receives the award associated with the winning symbol or combination of symbols. It can be frustrating for a player to "almost win an award" when the symbols necessary for a winning combination appear together on the reels but are not in the proper configuration or order to produce a winning combination. One popular game feature which attempts to rectify the player's frustration in such a situation and increase the player's award opportunities is commonly referred to as a nudge feature or option. A nudge occurs after the reels initially spin and stop allowing the game or the player to move the reels through a limited rotation from a first or non-winning to a second and possibly winning position (to effect a winning combination or align a winning combination on an active pay line).

The above are generally methodologies which are actively engaged by player action. There are circumstances in which either visually displayed or hidden conversion of losing outcomes to winning or potentially winning outcomes can be advantageous.

For example, there is underlying pseudorandom generating technology used to provide random outcomes on reel-type slot machines or the video equivalents thereof in electronic (video) gaining machines. For example, U.S. Pat. No. 6,159,096 (Yoseloff) discloses a method of configuring a reel-slot gaining device to randomly generate game outcome. The method includes the steps of selecting a set of game symbols, assigning a probability of occurrence to each symbol, selecting a plurality of outcome templates, each template comprising X variables, selecting a probability of occurrence for each outcome template, assigning a subset of symbols from the set of game symbols to each template for defining the variables, defining payouts for selected outcomes, and configuring a reel-slot gaining device having X reels, which randomly selects a template, randomly selects a symbol for each position in the template from the subset of game symbols assigned to the selected template, randomly fills at least a portion of the positions in the template and displays the outcome. A gaining device configured to randomly generate game outcomes is also disclosed.

That method was an alternative to U.S. Pat. No. 4,448,419 (Telnaes) which provides a system by which inherent payout limitations of mechanical and electromechanical reel-slot machines have been overcome in part by offering machines configured according to a method disclosed in Telnaes U.S. Pat. No. 4,448,419 A method provides payout odds which are independent of the hit frequencies determined by the geometry of a reel-slot machine. "Virtual" addresses are provided on one or more reels. For example, in a twenty reel stop position reel, position 19 may be assigned random numbers 1 and 21. When the random number generator selects 21, for example, a microprocessor instructs the device to display the symbol assigned to "virtual" stop 21. The microprocessor then instructs the reel to stop at a reel stop position bearing a symbol that matches the symbol assigned to virtual stop 21. This position need not be position 19. This technology advantageously allows the game designer to define the probability of occurrence of a selected symbol that is different from a conventional three reel-slot machine. For example, a cherry symbol might be present on only one out of twenty reel stop positions, with a probability of occurrence of 1/20 or 0.05 for a cherry on that particular reel. By providing, for example, a reel with 60 "virtual" reel positions, and by assigning a cherry symbol to two of the addresses, the odds of the cherry appearing on the same reel can be changed from 1 in 20 (0.05) to 2 in 60 or (0.0333).

U.S. Pat. No. 5,569,084 (Nicastro et al.) describes a method of selecting a probability of occurrence of selected symbol combinations in a reel-slot game. According to a first example, all possible game outcomes (symbol combinations) are first defined. Each outcome is assigned to a position on a "branching tree" stored in ROM memory. The branching tree includes a main tier, branching tiers and terminal nodes. In the first example, each possible outcome is assigned to a terminal node. Each branching tier is assigned a probability of occurrence. This probability, along with the number of terminal nodes assigned to the branching tier determines the probability of occurrence of the symbol combination assigned to the terminal node. By selecting the position of each outcome on the branching tree, and the number of terminal nodes, if any, the probability of occurrence of each outcome is defined.

The present technology is believed to provide both an additional underlying methodology for providing distributions and probabilities for electronic gaining machines and a method for providing players with a winning outcome when a first, specifically identified, non-winning outcome is displayed.

SUMMARY OF THE INVENTION

DETAILED DESCRIPTION OF THE INVENTION

Figure 1:
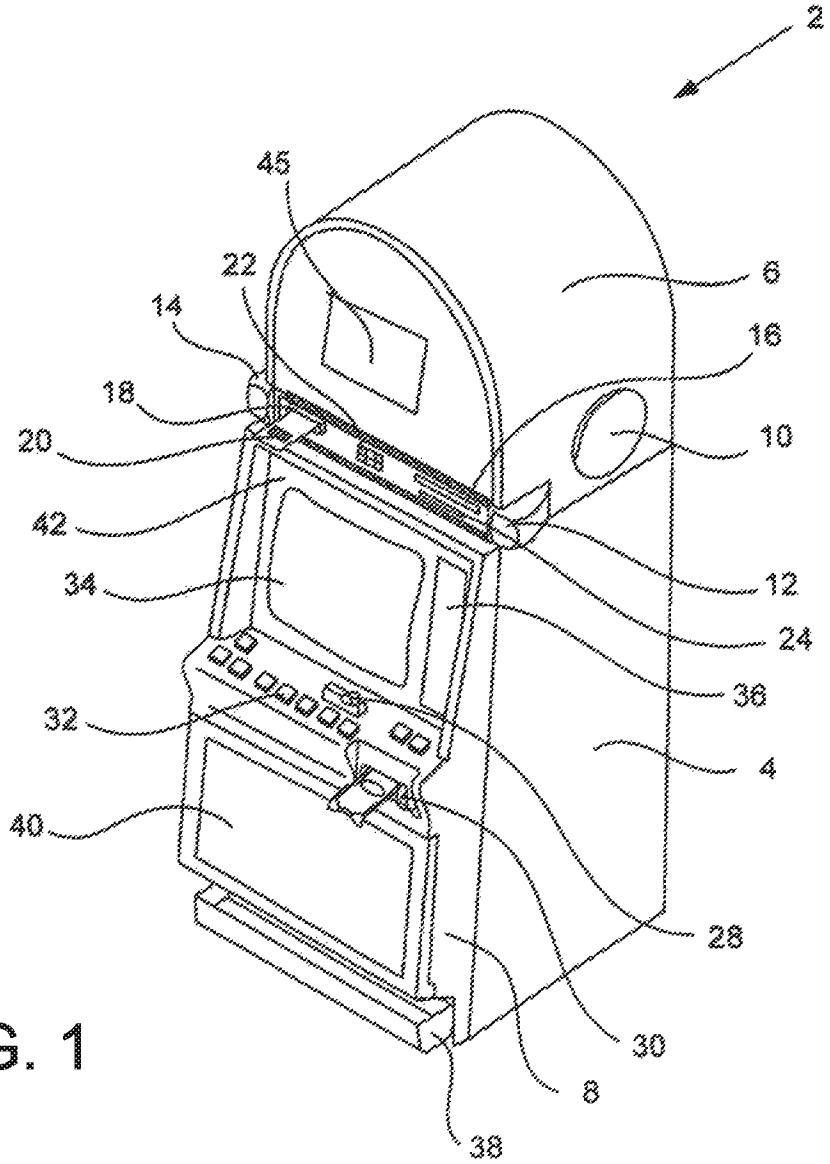
FIG. 1 shows an electronic gaining table on which the gaining method may be executed.

A method generates outcomes in an electronic gaining machine comprising a housing, a visual display, a processor associated with memory, player input controls and a value-in-value-out function selected from the group consisting of a) a ticket reader and ticket printer, b) a currency validator, c) coin recognition element, and d) an electronic wallet receiver and transmitter. The method and apparatus enables both a possibility of increased player entertainment and marginal or incremental adjustments in long-term statistical house hold percentages that are programmable, adjustable, and visible or not to the players. The overall structure of the method may include:

i) the electronic gaining machine accepting a wager through the player input controls accessing credit received by the processor through the value-in-value-out function;

ii) the processor randomly providing a first random outcome which determines whether the wager is initially resolved by the processor as a winning outcome, tie outcome or losing outcome.

The random outcome can be any visually observed pattern or distribution of symbols or events which can be resolved against a pay table. For a simplest example, consider A 3 frame by 3 frame display on a video screen having traditional slot machine symbols of cherries, bars, bells, plums, sevens, blank spaces, oranges and lemons available for random display. Winning events may, for example, be at least one cherry in any position on a pay line (which for purposes of explanation will be any horizontal line of three frames), three bars, three sevens, three bells and three plums. All other outcomes are considered non-winning outcomes in which all wagers are lost by the player accounting function in the gaining apparatus. This limited number of winning outcomes and the narrow range of odds in the pay table for these outcomes (e.g., 100:1 for three sevens, 50:1 for three bars, 10:1 for three cherries, 3:1 for two cherries, 1:1 for one cherry, 4:1 for three bells, and 2:1 for three plums can limit the precision with which payout rates can be controlled by traditional alterations in individual frequencies and alterations in gross payout odds. As now described, the present invention offers a mechanism for incremental adjustment of long-term (e.g., 10,000 plays) payout rates and casino hold percentages.

To appreciate this effect, it must be understood that there is an inherent, although minuscule, time lag between the random outcome gaining events and their display on the screen. The random number generator determines what the random event outcome is, and then that random event outcome is displayed on the screen. Without adjusting the pay tables described above for the winning events, incremental increases or adjustments in the overall payout rates can be achieved by identifying at least one specific event (which may be a winning event, a tie event or a losing event, although the last is preferred), and on occurrence of the at least one specific event, a second spin (re-spin) of at least one payline is effected which offers a potential for a different outcome and/or amount of award than the original (primary) spin. In the case of losing events being one of or the only one of the specific events, the following example shows that when a specific one of the losing events (e.g., bar-bar-seven) will be subject to a further random event, that further random event (the second spin or re-spin) which might or might not create a winning outcome for the player on that particular bar-bar-seven outcome before it, or its substitute, occurs or is displayed (the original outcome may never be displayed). For example, if the random number generator provides the bar-bar-seven random outcome, the processor may require that the random number generator immediately (before display of the outcome) generate another random outcome event that includes a possible winning outcome. By controlling the number of possible second outcomes, the value of the second outcomes and the probability of the individual second outcomes, a more elegant and incremental adjustment of payout rates can be provided.

For example, with only the bar-bar-seven outcome being considered, that losing outcome may occur less than 0.1% of the time. The second outcomes may comprise only X % frequency for blank-bar-blank, Y % for two cherries and Z % for three plums. X+Y+Z equals 100%. By adjusting the frequency of the three second outcomes, the overall impact of the bar-bar-seven primary outcome on long-term house advantage and payouts can be incrementally adjusted. For example, with X being 50%, Y being 40% and Z being 10%, rather than the payout from bar-bar-seven always being zero (0), it now has a probability of 0.50×0 plus 0.40×3 and 0.10×2 (0+1.2+0.2=1.4) increment on the overall payout by the gaining machine with this game programmed in it. This method therefore, even considering only the single bar-bar-seven primary outcome, can adjust the overall payback rate and house hold of the programmed gaining event by a minuscule, but controllable amount, which in the present example, might approximate 0.0012 percent). Although this may seem small, by altering the probability for winning second events, the amount of individual ones of the second events, and adding additional losing primary events to a total of losing events that will be addressed by the program to offer an opportunity of a winning outcome, a more precise control of house hold and payback percentages can be embedded into the statistics and probabilities of any game. For example, the system may be used to increase payback rates from almost any increment between 0.000001 percent up to 20% or more.

After the processor recognizes specific ones of, but less than all of the tie outcomes and/or the losing outcomes as belonging to a provisional subset of tie outcomes and/or losing outcomes, the processor will then recognizes that specific primary random outcome as within the provisional subset. The processor then randomly selects from among multiple additional outcomes stored in memory for at least individual ones of random outcomes within the provisional subset, and randomly selecting a final random outcome for the at least individual one of the random outcomes within the provisional subset from a second set of random outcomes that includes at least one winning outcome, and resolving the wager on the basis of the final random outcome.

The method may be performed with two distinct objectives. In a first objective, the methodology is used exclusively to adjust payback rates without any direct knowledge of the event being relayed to a player. In that methodology, iii) is performed without display of any first random outcome that falls within the provisional subset, at least until iii) has been completed and a final random outcome provided. Also in the first methodology, iii) is performed without display of any first random outcome that falls within the provisional subset.

The method may alternatively be performed in a manner that shows to the player that a specific "losing" outcome is being given a second chance to win. After the specific losing outcome is displayed, possibly with some fanfare or razzle-dazzle on the screen to indicate the beneficial event, the second random outcome is shown. This can be done as just another automatic re-spin being shown for that pay line (without impacting any specific other pay line that may be a winning outcome), or the possible options for the re-spin are shown in a separate part of the screen, the re-spin occurs, and the second outcome is displayed on the pay line (as a win or non-win event). In this manner, iii) is performed after display of any first random outcome that falls within the provisional subset, and subsequently after iii) has been completed, the final random outcome is displayed and the wager resolved.

An alternative description for a general process according to the present technology may include a method for generating outcomes in an electronic gaining machine comprising a housing, a visual display, a processor associated with memory, player input controls and a value-in-value-out function selected from the group consisting of a) a ticket reader and ticket printer, b) a currency validator, c) coin recognition element, and d) an electronic wallet receiver and transmitter: wherein i) the electronic gaining machine accepts a wager through the player input controls accessing credit received by the processor through the value-in-value-out function;

ii) the processor randomly provides a first random outcome which determines whether the wager is initially resolved by the processor as a winning outcome, tie outcome or losing outcome; further wherein, the processor recognizes at least one specific first random outcome as belonging to a provisional subset of the outcomes, and where the processor recognizes a random outcome as within the provisional subset, the processor randomly selecting from among multiple additional outcomes stored in memory for at least individual ones of random outcomes within the provisional subset, and randomly selects a final random outcome for the at least individual one of the random outcomes within the provisional subset from a second set of random outcomes that includes at least one winning outcome, and resolves the wager on the basis of the final random outcome. The subset may include at least one random outcome selected from the group consisting of winning outcomes, ties and losing outcomes. By using a winning outcome or tie outcome as within the subset for which a re-spin is effected, payout probabilities may be incrementally reduced (by providing a reduced winning amount or converting a tie to a loss) as well as increased (with conversion of losing events, alteration of the event outcome to a tie or win can only increment winning percentages).

The present technology is not limited to typical reel-type slot machines showing one or more paylines for symbols, but mat be used in combination with video poker-type gaining events, keno events, bingo events (especially where single players are at single electronic gaining machines), video blackjack and video baccarat.

For example, with single payline video poker, the second random outcome after drawing to a single King (no pairs) in the first random outcome may have provided only a non-winning pair of tens. By implementation of the present technology, a pair of tens with a King kicker (held over from the first ransom event) may be part of a subset in which there is a re-spin with 50% probability of no poker hand rank improvement, 45% probability of improvement to a pair of kings, 4% probability of improvement to three kings, and 1% probability of improvement to a straight. It is preferred that the present technology use a specific second subset of possible re-spin outcomes for each first random outcome for which a re-spin is mandated, as opposed to there being a general re-spin using standard probabilities for all theoretically possible outcomes, which would give less control of the statistical payout rates.

The technology may be performed in various electronic modes. Turning next to FIG. 1, a video gaining machine 2 of the present invention is shown. Machine 2 includes a main cabinet 4, which generally surrounds the machine interior (not shown) and is viewable by users. The main cabinet includes a main door 8 on the front of the machine, which opens to provide access to the interior of the machine. Attached to the main door are player-input switches or buttons 32, a coin acceptor 28, and a bill validator 30, a coin tray 38, and a display area including a mechanical gaming system (or less preferably a separate electronic game) 40. There may be an overlay of touchscreen functionality on the separate electronic game 40 or some of the buttons 32 may be functional on the separate mechanical gaming system 40. That separate mechanical gaming system may be in a relatively vertical viewing position as shown or in a more horizontal (table like) display unit. Viewable through the main door is a video display monitor 34 and an information panel 36. The display monitor 34 will typically be a cathode ray tube, high resolution flat-panel LCD, LED, plasma screen or other conventional electronically controlled video monitor. The information panel 36 may be a back-lit, silk screened glass panel with lettering to indicate general game information including, for example, a game denomination (e.g. $0.25 or $1). The bill validator 30, player-input switches 32, video display monitor 34, and information panel are devices used to play a game on the game machine 2. The devices are controlled by circuitry (e.g. the master gaming controller) housed inside the main cabinet 4 of the machine 2.

Many different types of games, including mechanical slot games, video slot games, video poker, video black jack, video pachinko and lottery, may be provided with gaming machines of this invention. In particular, the gaming machine 2 may be operable to provide a play of many different instances of games of chance. The instances may be differentiated according to themes, sounds, graphics, type of game (e.g., slot game vs. card game), denomination, number of paylines, maximum jackpot, progressive or non-progressive, bonus games, etc. The gaining machine 2 may be operable to allow a player to select a game of chance to play from a plurality of instances available on the gaming machine. For example, the gaming machine may provide a menu with a list of the instances of games that are available for play on the gaming machine and a player may be able to select from the first a first instance of a game of chance that they wish to play.

The various instances of games available for play on the gaining machine 2 may be stored as game software on a mass storage device in the gaming machine or may be generated on a remote gaming device but then displayed on the gaming machine. The gaming machine 2 may executed game software, such as but not limited to video streaming software that allows the game to be displayed on the gaining machine. When an instance is stored on the gaming machine 2, it may be loaded from the mass storage device into a RAM for execution. In some cases, after a selection of an instance, the game software that allows the selected instance to be generated may be downloaded from a remote gaming device, such as another gaming machine.

The gaming machine 2 includes a top box 6, which sits on top of the main cabinet 4. The top box 6 houses a number of devices, which may be used to add features to a game being played on the gaming machine 2, including speakers 10, 12, 14, a ticket printer 18 which prints bar-coded tickets 20, a key pad 22 for entering player tracking information, a florescent display 16 for displaying player tracking information, a card reader 24 for entering a magnetic striped card containing player tracking information, and a video display screen 42. The ticket printer 18 may be used to print tickets for a cashless ticketing system. Further, the top box 6 may house different or additional devices than shown in the FIG. 1. For example, the top box may contain a bonus wheel or a back-lit silk screened panel which may be used to add bonus features to the game being played on the gaming machine. As another example, the top box may contain a display for a progressive jackpot offered on the gaming machine. During a game, these devices are controlled and powered, in part, by circuitry (e.g. a master gaining controller) housed within the main cabinet 4 of the machine 2.

Understand that gaming machine 2 is but one example from a wide range of gaming machine designs on which the present invention may be implemented. For example, not all suitable gaming machines have top boxes or player tracking features. Further, some gaming machines have only a single game display mechanical or video, while others are designed for bar tables and have displays that face upwards. As another example, a game may be generated in on a host computer and may be displayed on a remote terminal or a remote gaining device. The remote gaining device may be connected to the host computer via a network of some type such as a local area network, a wide area network, an intranet or the Internet. The remote gaming device may be a portable gaming device such as but not limited to a cell phone, a personal digital assistant, and a wireless game player. Images rendered from 3-D gaming environments may be displayed on portable gaming devices that are used to play a game of chance. Further a gaming machine or server may include gaming logic for commanding a remote gaining device to render an image from a virtual camera in a 3-D gaining environments stored on the remote gaming device and to display the rendered image on a display located on the remote gaming device. Thus, those of skill in the art will understand that the present invention, as described below, can be deployed on most any gaming machine now available or hereafter developed.

Some preferred gaming machines are implemented with special features and/or additional circuitry that differentiates them from general-purpose computers (e.g desktop PC's and laptops). Gaming machines are highly regulated to ensure fairness and, in many cases, gaining machines are operable to dispense monetary awards of multiple millions of dollars. Therefore, to satisfy security and regulatory requirements in a gaming environment, hardware and software architectures may be implemented in gaming machines that differ significantly from those of general-purpose computers, A description of gaming machines relative to general-purpose computing machines and some examples of the additional (or different) components and features found in gaming machines are described below.

At first glance, one might think that adapting PC technologies to the gaming industry would be a simple proposition because both PCs and gaming machines employ microprocessors that control a variety of devices. However, because of such reasons as 1) the regulatory requirements that are placed upon gaming machines, 2) the harsh environment in which gaining machines operate, 3) security requirements and 4) fault tolerance requirements, adapting PC technologies to a gaming machine can be quite difficult. Further, techniques and methods for solving a problem in the PC industry, such as device compatibility and connectivity issues, might not be adequate in the gaming environment. For instance, a fault or a weakness tolerated in a PC, such as security holes in software or frequent crashes, may not be tolerated in a gaining machine because in a gaining machine these faults can lead to a direct loss of funds from the gaming machine, such as stolen cash or loss of revenue when the gaming machine is not operating properly.

For the purposes of illustration, a few differences between PC systems and gaming systems will be described. A first difference between gaining machines and common PC based computers systems is that gaming machines are designed to be state-based systems. In a state-based system, the system stores and maintains its current state in a non-volatile memory, such that, in the event of a power failure or other malfunction the gaming machine will return to its current state when the power is restored. For instance, if a player was shown an award for a game of chance and, before the award could be provided to the player the power failed, the gaming machine, upon the restoration of power, would return to the state where the award is indicated. As anyone who has used a PC, knows, PCs are not state machines and a majority of data is usually lost when a malfunction occurs. This requirement affects the software and hardware design on a gaming machine.

A second important difference between gaming machines and common PC based computer systems is that for regulation purposes, the software on the gaming machine used to generate the game of chance and operate the gaming machine has been designed to be static and monolithic to prevent cheating by the operator of gaining machine. For instance, one solution that has been employed in the gaining industry to prevent cheating and satisfy regulatory requirements has been to manufacture a gaming machine that can use a proprietary processor running instructions to generate the game of chance from an EPROM or other form of non-volatile memory. The coding instructions on the EPROM are static (non-changeable) and must be approved by a gaming regulators in a particular jurisdiction and installed in the presence of a person representing the gaming jurisdiction. Any changes to any part of the software required to generate the game of chance, such as adding a new device driver used by the master gaming controller to operate a device during generation of the game of chance can require a new EPROM to be burnt, approved by the gaining jurisdiction and reinstalled on the gaming machine in the presence of a gaming regulator. Regardless of whether the EPROM solution is used, to gain approval in most gaming jurisdictions, a gaming machine must demonstrate sufficient safeguards that prevent an operator or player of a gaining machine from manipulating hardware and software in a manner that gives them an unfair and some cases an illegal advantage. The gaining machine should have a means to determine if the code it will execute is valid. If the code is not valid, the gaming machine must have a means to prevent the code from being executed. The code validation requirements in the gaming industry affect both hardware and software designs on gaming machines.

A third important difference between gaming machines and common PC based computer systems is the number and kinds of peripheral devices used on a gaming machine are not as great as on PC based computer systems. Traditionally, in the gaming industry, gaming machines have been relatively simple in the sense that the number of peripheral devices and the number of functions the gaming machine has been limited. Further, in operation, the functionality of gaining machines were relatively constant once the gaining machine was deployed, i.e., new peripherals devices and new gaining software were infrequently added to the gaming machine. This differs from a PC where users will go out and buy different combinations of devices and software from different manufacturers and connect them to a PC to suit their needs depending on a desired application. Therefore, the types of devices connected to a PC may vary greatly from user to user depending in their individual requirements and may vary significantly over time.

Although the variety of devices available for a PC may be greater than on a gaming machine, gaming machines still have unique device requirements that differ from a PC, such as device security requirements not usually addressed by PCs. For instance, monetary devices, such as coin dispensers, bill validators and ticket printers and computing devices that are used to govern the input and output of cash to a gaming machine have security requirements that are not typically addressed in PCs. Therefore, many PC techniques and methods developed to facilitate device connectivity and device compatibility do not address the emphasis placed on security in the gaming industry.

To address some of the issues described above, a number of hardware/software components and architectures are utilized in gaming machines that are not typically found in general purpose computing devices, such as PCs. These hardware/software components and architectures, as described below in more detail, include but are not limited to watchdog timers, voltage monitoring systems, state-based software architecture and supporting hardware, specialized communication interfaces, security monitoring and trusted memory.

A watchdog timer is normally used in gaming machines to provide a software failure detection mechanism. In a normally operating system, the operating software periodically accesses control registers in the watchdog timer subsystem to "re-trigger" the watchdog. Should the operating software fail to access the control registers within a preset timeframe, the watchdog timer will timeout and generate a system reset. Typical watchdog timer circuits contain a loadable timeout counter register to allow the operating software to set the timeout interval within a certain range of time. A differentiating feature of the some preferred circuits is that the operating software cannot completely disable the function of the watchdog timer. In other words, the watchdog timer always functions from the time power is applied to the board.

Gaining computer platforms preferably use several power supply voltages to operate portions of the computer circuitry. These can be generated in a central power supply or locally on the computer board. If any of these voltages falls out of the tolerance limits of the circuitry they power, unpredictable operation of the computer may result, Though most modern general-purpose computers include voltage monitoring circuitry, these types of circuits only report voltage status to the operating software. Out of tolerance voltages can cause software malfunction, creating a potential uncontrolled condition in the gaming computer. Gaining machines typically have power supplies with tighter voltage margins than that required by the operating circuitry. In addition, the voltage monitoring circuitry implemented in gaming computers typically has two thresholds of control. The first threshold generates a software event that can be detected by the operating software and an error condition generated. This threshold is triggered when a power supply voltage falls out of the tolerance range of the power supply, but is still within the operating range of the circuitry. The second threshold is set when a power supply voltage falls out of the operating tolerance of the circuitry. In this case, the circuitry generates a reset, halting operation of the computer.

The standard method of operation for slot machine game software is to use a state machine. Different functions of the game (bet, play, result, points in the graphical presentation, etc.) may be defined as a state. When a game moves from one state to another, critical data regarding the game software is stored in a custom non-volatile memory subsystem. This is critical to ensure the player's wager and credits are preserved and to minimize potential disputes in the event of a malfunction on the gaming machine.

In general, the gaming machine does not advance from a first state to a second state until critical information that allows the first state to be reconstructed is stored. This feature allows the game to recover operation to the current state of play in the event of a malfunction, loss of power, etc. that occurred just prior to the malfunction. After the state of the gaming machine is restored during the play of a game of chance, game play may resume and the game may be completed in a manner that is no different than if the malfunction had not occurred. Typically, battery backed RAM devices are used to preserve this critical data although other types of non-volatile memory devices may be employed. These memory devices are not used in typical general-purpose computers.

As described in the preceding paragraph, when a malfunction occurs during a game of chance, the gaming machine may be restored to a state in the game of chance just prior to when the malfunction occurred. The restored state may include metering information and graphical information that was displayed on the gaming machine in the state prior to the malfunction. For example, when the malfunction occurs during the play of a card game after the cards have been dealt, the gaming machine may be restored with the cards that were previously displayed as part of the card game. As another example, a bonus game may be triggered during the play of a game of chance where a player is required to make a number of selections on a video display screen. When a malfunction has occurred after the player has made one or more selections, the gaming machine may be restored to a state that shows the graphical presentation at the just prior to the malfunction including an indication of selections that have already been made by the player. In general, the gaining machine may be restored to any state in a plurality of states that occur in the game of chance that occurs while the game of chance is played or to states that occur between the play of a game of chance.

Game history information regarding previous games played such as an amount wagered, the outcome of the game and so forth may also be stored in a non-volatile memory device. The information stored in the non-volatile memory may be detailed enough to reconstruct a portion of the graphical presentation that was previously presented on the gaming machine and the state of the gaming machine (e.g., credits) at the time the game of chance was played. The game history information may be utilized in the event of a dispute. For example, a player may decide that in a previous game of chance that they did not receive credit for an award that they believed they won. The game history information may be used to reconstruct the state of the gaming machine prior, during and/or after the disputed game to demonstrate whether the player was correct or not in their assertion.

Another feature of gaming machines, such as gaming computers, is that they often contain unique interfaces, including serial interfaces, to connect to specific subsystems internal and external to the slot machine. The serial devices may have electrical interface requirements that differ from the "standard" EIA 232 serial interfaces provided by general-purpose computers. These interfaces may include ETA 485, ETA 422, Fiber Optic Serial, optically coupled serial interfaces, current loop style serial interfaces, etc. In addition, to conserve serial interfaces internally in the slot machine, serial devices may be connected in a shared, daisy-chain fashion where multiple peripheral devices are connected to a single serial channel.

The serial interfaces may be used to transmit information using communication protocols that are unique to the gaming industry. For example, the Netplex™ system of IGT is a proprietary communication protocol used for serial communication between gaming devices. As another example, SAS is a communication protocol used to transmit information, such as metering information, from a gaming machine to a remote device. Often SAS is used in conjunction with a player tracking system.

Gaming machines may alternatively be treated as peripheral devices to a casino communication controller and connected in a shared daisy chain fashion to a single serial interface. In both cases, the peripheral devices are preferably assigned device addresses. If so, the serial controller circuitry must implement a method to generate or detect unique device addresses. General-purpose computer serial ports are not able to do this.

Security monitoring circuits detect intrusion into a gaining machine by monitoring security switches attached to access doors in the slot machine cabinet. Preferably, access violations result in suspension of game play and can trigger additional security operations to preserve the current state of game play. These circuits also function when power is off by use of a battery backup. In power-off operation, these circuits continue to monitor the access doors of the slot machine. When power is restored, the gaining machine can determine whether any security violations occurred while power was off, e.g., via software for reading status registers. This can trigger event log entries and further data authentication operations by the slot machine software.

Trusted memory devices are preferably included in a gaming machine computer to ensure the authenticity of the software that may be stored on less secure memory subsystems, such as mass storage devices. Trusted memory devices and controlling circuitry are typically designed to not allow modification of the code and data stored in the memory device while the memory device is installed in the slot machine. The code and data stored in these devices may include authentication algorithms, random number generators, authentication keys, operating system kernels, etc. The purpose of these trusted memory devices is to provide gaming regulatory authorities a root trusted authority within the computing environment of the slot machine that can be tracked and verified as original. This may be accomplished via removal of the trusted memory device from the slot machine computer and verification of the secure memory device contents is a separate third party verification device. Once the trusted memory device is verified as authentic, and based on the approval of the verification algorithms contained in the trusted device, the gaming machine is allowed to verify the authenticity of additional code and data that may be located in the gaining computer assembly, such as code and data stored on hard disk drives. A few details related to trusted memory devices that may be used in the present invention are described in U.S. Pat. No. 6,685,567 titled "Process Verification," which is incorporated herein in its entirety and for all purposes.

Mass storage devices used in a general purpose computer typically allow code and data to be read from and written to the mass storage device. In a gaming machine environment, modification of the gaining code stored on a mass storage device is strictly controlled and would only be allowed under specific maintenance type events with electronic and physical enablers required. Though this level of security could be provided by software, gaining computers that include mass storage devices preferably include hardware level mass storage data protection circuitry that operates at the circuit level to monitor attempts to modify data on the mass storage device and will generate both software and hardware error triggers should a data modification be attempted without the proper electronic and physical enablers being present.

Returning to the example of FIG. 1, when a user wishes to play the gaming machine 2, he or she inserts cash through the coin acceptor 28 or bill validator 30. Additionally, the bill validator may accept a printed ticket voucher which may be accepted by the bill validator 30 as an indicia of credit when a cashless ticketing system is used. At the start of the game, the player may enter playing tracking information using the card reader 24, the keypad 22, and the florescent display 16. Further, other game preferences of the player playing the game may be read from a card inserted into the card reader. During the game, the player views game information using the video display 34. Other game and prize information may also be displayed in the video display screen 42 located in the top box.

During the course of a game, a player may be required to make a number of decisions, which affect the outcome of the game. For example, a player may vary his or her wager on a particular game, select a prize for a particular game selected from a prize server, or make game decisions which affect the outcome of a particular game. The player may make these choices using the player-input switches 32, the video display screen 34 or using some other device which enables a player to input information into the gaming machine. In some embodiments, the player may be able to access various game services such as concierge services and entertainment content services using the video display screen 34 and one more input devices.

During certain game events, the gaming machine 2 may display visual and auditory effects that can be perceived by the player. These effects add to the excitement of a game, which makes a player more likely to continue playing. Auditory effects include various sounds that are projected by the speakers 10, 12, 14. Visual effects include flashing lights, strobing lights or other patterns displayed from lights on the gaming machine 2 or from lights within the separate mechanical (or electronic) separately, individually wagerable gaming system 40. After the player has completed a game, the player may receive game tokens from the coin tray 38 or the ticket 20 from the printer 18, which may be used for further games or to redeem a prize. Further, the player may receive a ticket 20 for food, merchandise, or games from the printer 18.

Figure 1A:
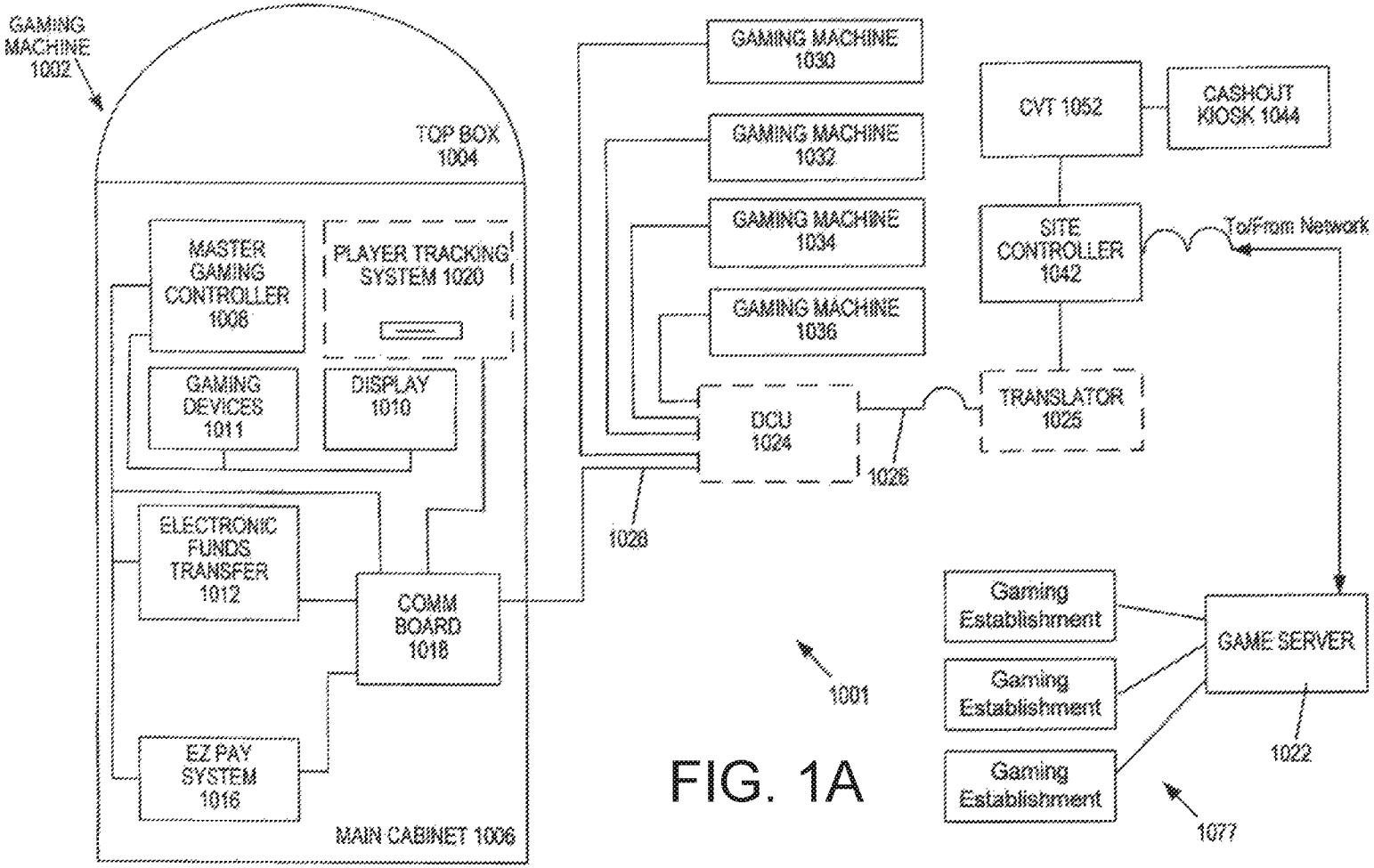
FIG. 1A shows a schematic for an electronic system for enabling play of the gaining method described herein.

Another gaining network that may be used to implement some aspects of the invention is depicted in FIG. 1A. Gaining establishment 1001 could be any sort of gaining establishment, such as a casino, a card room, an airport, a store, etc. In this example, gaining network 1077 includes more than one gaining establishment, all of which are networked to game server 1022. Here, gaining machine 1002, and the other gaining machines 1030, 1032, 1034, and 1036, include a main cabinet 1006 and a top box 1004. The main cabinet 1006 houses the main gaining elements and can also house peripheral systems, such as those that utilize dedicated gaining networks. The top box 1004 may also be used to house these peripheral systems.

The master gaining controller 1008 controls the game play on the gaining machine 1002 according to instructions and/or game data from game server 1022 or stored within gaining machine 1002 and receives or sends data to various input/output devices 1011 on the gaining machine 1002. In one embodiment, master gaining controller 1008 includes processor(s) and other apparatus of the gaining machines described above. The master gaining controller 1008 may also communicate with a display 1010.

A particular gaining entity may desire to provide network gaining services that provide some operational advantage. Thus, dedicated networks may connect gaining machines to host servers that track the performance of gaining machines under the control of the entity, such as for accounting management, electronic fund transfers (EFTs), cashless ticketing, such as EZPay™, marketing management, and data tracking, such as player tracking. Therefore, master gaining controller 1008 may also communicate with EFT system 1012, EZPay™ system, and player tracking system 1020. The systems of the gaining machine 1002 communicate the data onto the network 1022 via a communication board 1018.

It will be appreciated by those of skill in the art that embodiments of the present invention could be implemented on a network with more or fewer elements than are depicted in FIG. 1A. For example, player tracking system 1020 is not a necessary feature of some implementations of the present invention. However, player tracking programs may help to sustain a game player's interest in additional game play during a visit to a gaining establishment and may entice a player to visit a gaining establishment to partake in various gaining activities. Player tracking programs provide rewards to players that typically correspond to the player's level of patronage (e.g., to the player's playing frequency and/or total amount of game plays at a given casino). Player tracking rewards may be free meals, free lodging and/or free entertainment. Player tracking information may be combined with other information that is now readily obtainable by an SBG system.

Moreover, DCU 1024 and translator 1025 are not required for all gaining establishments 1001. However, due to the sensitive nature of much of the information on a gaining network (e.g., electronic fund transfers and player tracking data) the manufacturer of a host system usually employs a particular networking language having proprietary protocols. For instance, 10-20 different companies produce player tracking host systems where each host system may use different protocols. These proprietary protocols are usually considered highly confidential and not released publicly.

Further, gaining machines are made by many different manufacturers. The communication protocols on the gaining machine are typically hard-wired into the gaining machine and each gaining machine manufacturer may utilize a different proprietary communication protocol. A gaining machine manufacturer may also produce host systems, in which case their gaining machines are compatible with their own host systems. However, in a heterogeneous gaining environment, gaining machines from different manufacturers, each with its own communication protocol, may be connected to host systems from other manufacturers, each with another communication protocol. Therefore, communication compatibility issues regarding the protocols used by the gaining machines in the system and protocols used by the host systems must be considered.

A network device that links a gaining establishment with another gaining establishment and/or a central system will sometimes be referred to herein as a "site controller." Here, site controller 1042 provides this function for gaining establishment 1001. Site controller 1042 is connected to a central system and/or other gaining establishments via one or more networks, which may be public or private networks. Among other things, site controller 1042 communicates with game server 1022 to obtain game data, such as ball drop data, bingo card data, etc.

In the present illustration, gaining machines 1002, 1030, 1032, 1034 and 1036 are connected to a dedicated gaining network 1022. In general, the DCU 1024 functions as an intermediary between the different gaining machines on the network 1022 and the site controller 1042. In general, the DCU 1024 receives data transmitted from the gaining machines and sends the data to the site controller 1042 over a transmission path 1026. In some instances, when the hardware interface used by the gaining machine is not compatible with site controller 1042, a translator 1025 may be used to convert serial data from the DCU 1024 to a format accepted by site controller 1042. The translator may provide this conversion service to a plurality of DCUs.

Further, in some dedicated gaining networks, the DCU 1024 can receive data transmitted from site controller 1042 for communication to the gaining machines on the gaining network. The received data may be, for example, communicated synchronously to the gaining machines on the gaining network.

Here, CVT 1052 provides cashless and cashout gaining services to the gaining machines in gaining establishment 1001. Broadly speaking, CVT 1052 authorizes and validates cashless gaining machine instruments (also referred to herein as "tickets" or "vouchers"), including but not limited to tickets for causing a gaining machine to display a game result and cash-out tickets. Moreover, CVT 1052 authorizes the exchange of a cashout ticket for cash. These processes will be described in detail below. In one example, when a player attempts to redeem a cash-out ticket for cash at cashout kiosk 1044, cash out kiosk 1044 reads validation data from the cashout ticket and transmits the validation data to CVT 1052 for validation. The tickets may be printed by gaining machines, by cashout kiosk 1044, by a stand-alone printer, by CVT 1052, etc. Some gaining establishments will not have a cashout kiosk 1044. Instead, a cashout ticket could be redeemed for cash by a cashier (e.g. of a convenience store), by a gaining machine or by a specially configured CVT.

Figure 1B:
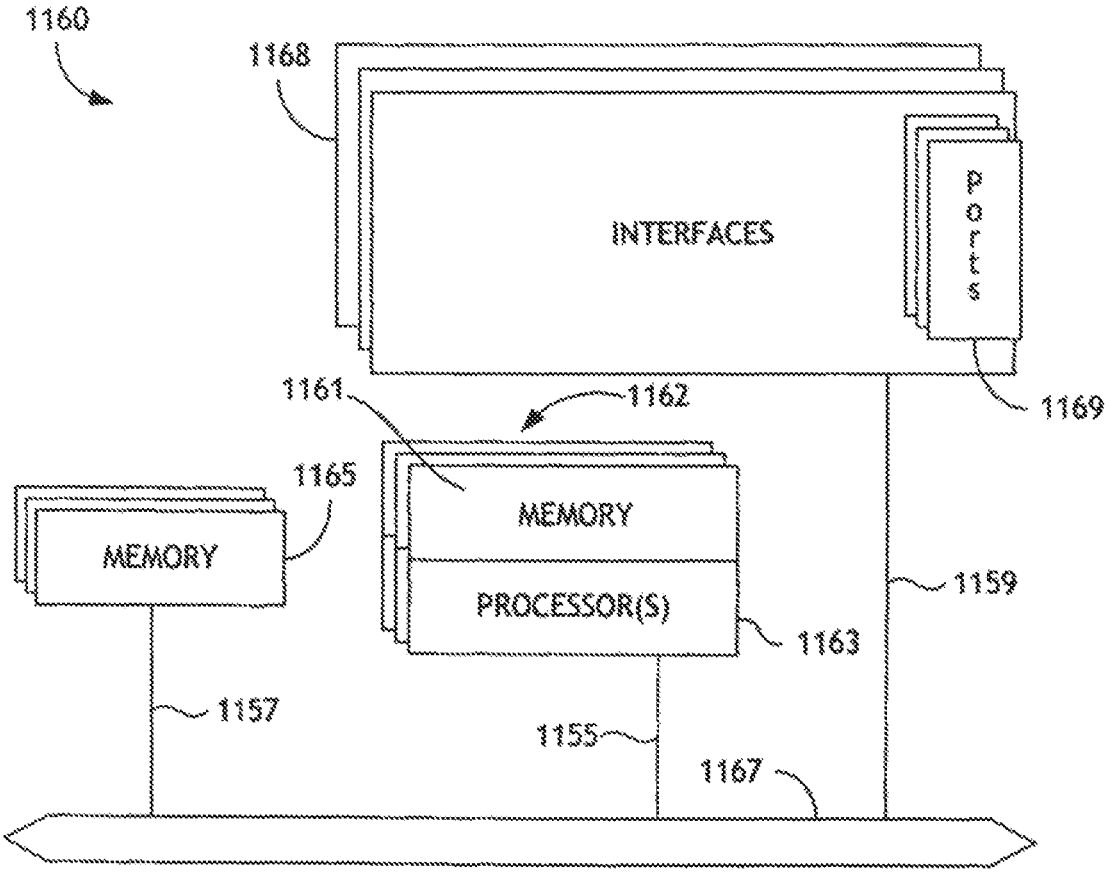
FIG. 1B shows another schematic for an electronic system for enabling play of the gaining method described herein.
Figure 2:
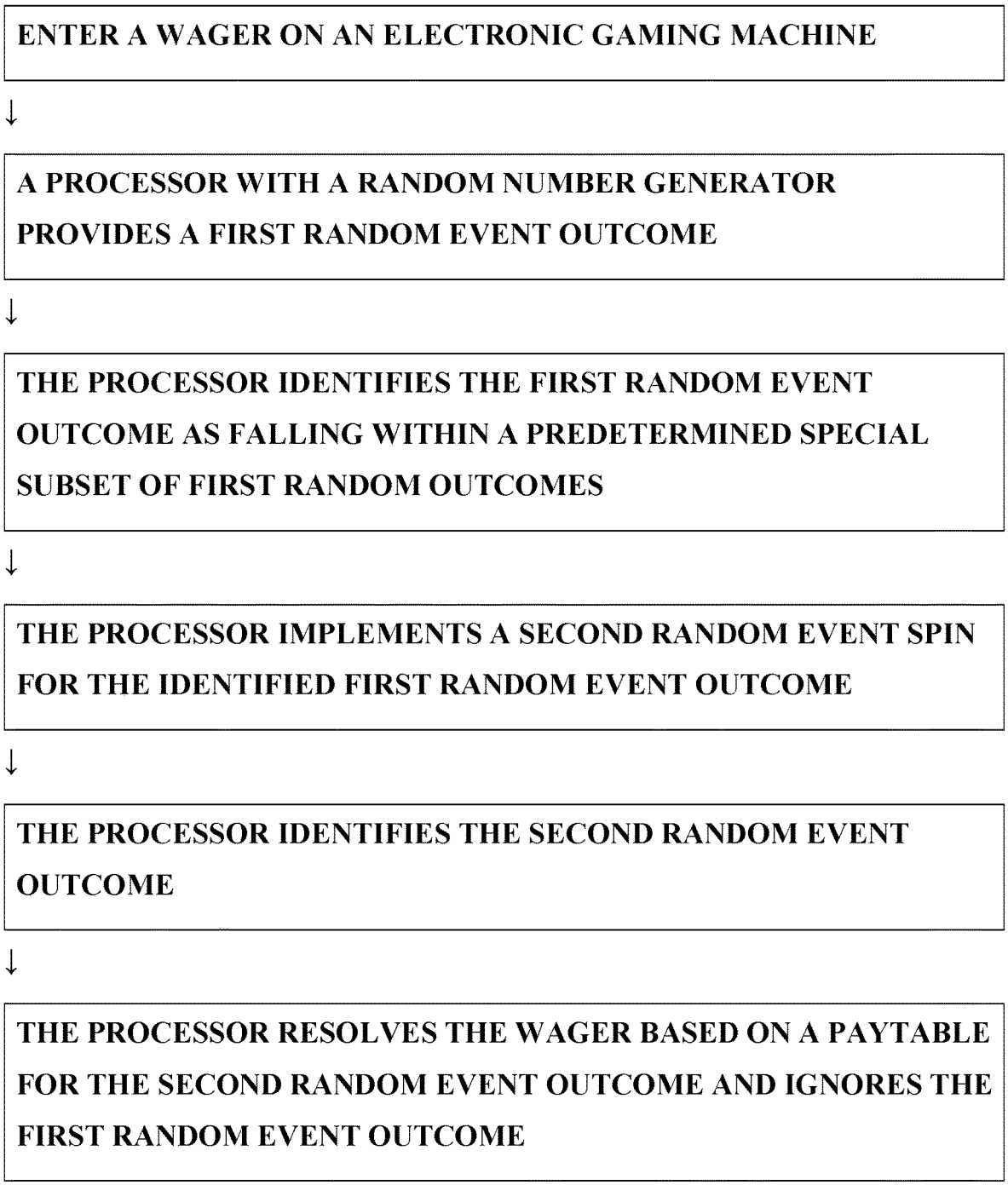
FIG. 2 shows a flow chart for practice of the present technology.

FIG. 1B illustrates an example of a network device that may be configured for implementing some methods of the present invention. Network device 1160 includes a master central processing unit (CPU) 1162, interfaces 1168, and a bus 1167 (e.g., a PCI bus). Generally, interfaces 1168 include ports 1169 appropriate for communication with the appropriate media. In some embodiments, one or more of interfaces 1168 includes at least one independent processor and, in some instances, volatile RAM. The independent processors may be, for example, ASICs or any other appropriate processors. According to some such embodiments, these independent processors perform at least some of the functions of the logic described herein. In some embodiments, one or more of interfaces 1168 control such communications-intensive tasks as encryption, decryption, compression, decompression, packetization, media control and management. By providing separate processors for the communications-intensive tasks, interfaces 1168 allow the master microprocessor 1162 efficiently to perform other functions such as routing computations, network diagnostics, security functions, etc.

The interfaces 1168 are typically provided as interface cards (sometimes referred to as "linecards"). Generally, interfaces 1168 control the sending and receiving of data packets over the network and sometimes support other peripherals used with the network device 1160. Among the interfaces that may be provided are FC interfaces, Ethernet interfaces, frame relay interfaces, cable interfaces, DSL interfaces, token ring interfaces, and the like. In addition, various very high-speed interfaces may be provided, such as fast Ethernet interfaces, Gigabit Ethernet interfaces, ATM interfaces, HSSI interfaces, POS interfaces, FDDI interfaces, ASI interfaces, DHEI interfaces and the like.

When acting under the control of appropriate software or firmware, in some implementations of the invention CPU 1162 may be responsible for implementing specific functions associated with the functions of a desired network device. According to some embodiments, CPU 1162 accomplishes all these functions under the control of software including an operating system and any appropriate applications software.

CPU 1162 may include one or more processors 1163 such as a processor from the Motorola family of microprocessors or the MIPS family of microprocessors. In an alternative embodiment, processor 1163 is specially designed hardware for controlling the operations of network device 1160. In a specific embodiment, a memory 1161 (such as non-volatile RANI and/or ROM) also forms part of CPU 1162. However, there are many different ways in which memory could be coupled to the system. Memory block 1161 may be used for a variety of purposes such as, for example, caching and/or storing data, programming instructions, etc.

Regardless of network device's configuration, it may employ one or more memories or memory modules (such as, for example, memory block 1165) configured to store data, program instructions for the general-purpose network operations and/or other information relating to the functionality of the techniques described herein. The program instructions may control the operation of an operating system and/or one or more applications, for example.

Because such information and program instructions may be employed to implement the systems/methods described herein, the present invention relates to machine-readable media that include program instructions, state information, etc. for performing various operations described herein. Examples of machine-readable media include, but are not limited to, magnetic media such as hard disks, floppy disks, and magnetic tape; optical media such as CD-ROM disks; magneto-optical media; and hardware devices that are specially configured to store and perform program instructions, such as read-only memory devices (ROM) and random access memory (RAM). The invention may also be embodied in a carrier wave traveling over an appropriate medium such as airwaves, optical lines, electric lines, etc. Examples of program instructions include both machine code, such as produced by a compiler, and files containing higher-level code that may be executed by the computer using an interpreter.

Although the system shown in FIG. 1B illustrates one specific network device of the present invention, it is by no means the only network device architecture on which the present invention can be implemented. For example, an architecture having a single processor that handles communications as well as routing computations, etc. is often used. Further, other types of interfaces and media could also be used with the network device. The communication path between interfaces may be bus based (as shown in FIG. 1B) or switch fabric based (such as a cross-bar).

The term digital wallet is a blanket descriptor for a range of technologies that let you perform many tasks. In general, though, a digital wallet (also sometimes called e-wallet) is a transformation in the way individuals pay for things.

Many digital wallet services work through apps on smartphones. At the supermarket, for instance, the phone is simply tapped to a compatible check-out register to pay instantly. For others, all you need to enter is a mobile phone number and a PIN (personal identification number).

No matter what form it takes, a digital wallet is based on encryption software that substitutes for old software, analog wallet during monetary transactions. There are benefits in the protection and convenience. Merchants benefit because they're more protected against fraud and they sell more products, faster.

A smartphone digital wallet will help pay for anything, but it will also store concert tickets, bus and subway passes, gift cards and in the present technology, credit stored, transferred or received from an electronic gaming machine. Casinos will reward loyalty by offering instant freebies, discounts and coupons.

Digital wallets can be broken into two broad categories: client-side and server-side. Within both categories are wallets that function only with specific vendors (either online or offline) and others that will work with just about any merchant.

Client-side wallets generally refer to those maintained by the customer, the end user. They download and install a program and then enter all of pertinent payment and shipping information, all of which is stored on a personal computer. Then, when it is decided to check out at a compatible Web site, the wallet's software completes most of the basic information so the customer doesn't have to. Suddenly, gaming gets faster and advantageous to the casino. A mobile digital wallet—that is, one on a smartphone—could transform the way customers pay no matter where they are in the casino.

More than half of Americans now own smartphones, and experts say that number will only continue to rise and more of those phones are equipped with NFC (near-field communication) chip, which is a vital component to the mobile digital wallet infrastructure. It was estimated that around half of smartphones could have NFC by 2015. NFC technology may be seen everywhere very soon.

In marketing to consumers, two hot-button words always appear: security and privacy. Ifs easy for people to imagine all of the ways criminals or even casinos could abuse digital wallets. Those could hack into the account, exhaust the account and run up credit card balances, or maybe steal an identity.

Concerns are heightened when laypeople are considering the complexity of a digital-wallet transaction, especially compared to the simplicity of cash or straight credit. In the case of a smartphone, data passes through not only the smartphone's hardware and operating system but then also through a specific payment app, and finally, the source of the payment, such as a bank or PayPal account. Casinos will be falling all over themselves to get player digital wallet business. Household names such as Google, Visa, MasterCard, Verizon, Apple, AT&T, PayPal and Square will be vying for players' attention.

All of these organizations will position themselves for the upper hand, in part by creating alliances with other corporate players in the gaming industry. PayPal started with Home Depot. Square teamed up with Starbucks. Google Wallet first matched with MasterCard. It's all part of the plan to slowly build their way into the casinos' normal operation. They know that if they can convince players and casinos to use their form of wallet first, players and casinos be unlikely to switch for an extended period of time.

Eventually, digital will complete its takeover and it is likely most wagering (with the exception of craps and roulette) will be using virtual money. Whether that's a good thing remains to be seen. In the meantime, players fumble with cash, tickets, coins and paper transactions with cashiers, all of which are remnants of a pre-digital economy and are primitive (and sometimes aggravating) simply by the nature of their design. Digital, of course, will have its own set of frustrations, and until they are confronted, the industry will not be assured they are worth the trouble of giving up cash.

A Google Wallet is inherently no different from any other money wallet. The basics behind all the wallets are the same. Each wallet is a bank account in some banking system. The entire eco system of wallet users, are simply a singular branch. If the name "PayPal" is changed, it depicts very well how a digital money wallet works.

Among technical disclosures of electronic payment systems are US Patent Application Published Documents No. 2013/0344161; 2014/0214654; 2006/0059038; and 2003/0034378; and U.S. Pat. No. 6,726,100.

Other variations can be added to the underlying execution of the wagering event.

The invention claimed is:

1. A method for generating outcomes in an electronic gaming machine comprising a housing, a visual display, a processor associated with memory, player input controls and a value-in-value-out function selected from the group consisting of a) a ticket reader and ticket printer, b) a currency validator, c) coin recognition element, and d) an electronic wallet receiver and transmitter, the method comprising:

i) the electronic gaming machine accepts a wager through the player input controls accessing credit received by the processor through the value-in-value-out function;

ii) the processor randomly provides a first random outcome which determines whether the wager is initially resolved by the processor as outcomes selected from the group consisting of a winning outcome, a tie outcome or a losing outcome; further wherein, the processor recognizes specific ones of, but less than all outcomes selected from the group consisting of the tie outcomes and the losing outcomes as belonging to a provisional subset of at least one of the tie outcomes and losing outcomes, and iii) where when the processor recognizes the first random outcome as within the provisional subset, the processor randomly selects, from among multiple additional outcomes stored in memory, at least individual ones of random outcomes within the provisional subset, and then randomly selects a final random outcome for the at least individual ones of the random outcomes within the provisional subset from a second set of random outcomes that includes at least one winning outcome, and resolving the wager on the basis of the final random outcome, and wherein iii) is performed without display of any first random outcome that falls within the provisional subset, at least until iii) has been completed and the final random outcome provided.

2. The method of claim 1 wherein iii) is performed after display of any first random outcome that falls outside of the provisional subset, and subsequently after iii) has been completed, the final random outcome is displayed and the wager resolved.

3. The method of claim 2 wherein performance of ii) and iii) increases statistical payout to players as compared to an otherwise identical method excluding performance of ii) and iii).

4. The method of claim 3 wherein only losing outcomes are included within the provisional subset of ii) and iii.

5. The method of claim 2 wherein only losing outcomes are included within the provisional subset of ii) and iii).

6. The method of claim 5 wherein only losing outcomes are included within the provisional subset of ii) and iii), and at least one losing outcome provides an appearance on the visual display of a losing random event that nearly resembles a winning gaming event outcome.

7. The method of claim 2 wherein only losing outcomes are included within the provisional subset of ii) and iii), and at least one losing outcome provides an appearance on the visual display of a losing random event that nearly resembles a winning gaming event outcome.

8. The method of claim 1 wherein performance of ii) and iii) increases statistical payout to players as compared to an otherwise identical method excluding performance of ii) and iii).

9. The method of claim 8 wherein only losing outcomes are included within the provisional subset of ii) and iii).

10. The method of claim 1 wherein only losing outcomes are included within the provisional subset of ii) and iii).

11. A method for generating outcomes in an electronic gaming machine comprising a housing, a visual display, a processor associated with memory, player input controls and a value-in-value-out function selected from the group consisting of a) a ticket reader and ticket printer, b) a currency validator, c) coin recognition element, and d) an electronic wallet receiver and transmitter, the method comprising:

i) the electronic gaming machine accepts a wager through the player input controls accessing credit received by the processor through the value-in-value-out function;

ii) the processor randomly provides a first random outcome which determines whether the wager is initially resolved by the processor as outcomes selected from the group consisting of a winning outcome, a tie outcome or a losing outcome; further wherein, the processor recognizes specific ones of, but less than all outcomes selected from the group consisting of the tie outcomes and the losing outcomes as belonging to a provisional subset of at least one of the tie outcomes and losing outcomes, and iii) where when the processor recognizes the first random outcome as within the provisional subset, the processor randomly selects from among multiple additional outcomes stored in memory for at least individual ones of random outcomes within the provisional subset, and then randomly selects a final random outcome for the at least individual ones of the random outcomes within the provisional subset from a second set of random outcomes that includes at least one winning outcome, and resolving the wager on the basis of the final random outcome, and wherein iii) is performed without display of any first random outcome that falls within the provisional subset.

12. The method of claim 11 wherein only losing outcomes are included within the provisional subset of ii) and iii).

* * * * *